US005165049A

United States Patent [19]

Rotman

[11] Patent Number: 5,165,049

[45] Date of Patent: Nov. 17, 1992

[54] PHASE DIFFERENCE CONTROL CIRCUIT FOR INDUCTION FURNACE POWER SUPPLY

[75] Inventor: Simeon Z. Rotman, Brooklyn, N.Y.

[73] Assignee: Inductotherm Corp., Rancocas, N.J.

[21] Appl. No.: 600,333

[22] Filed: Oct. 19, 1990

Related U.S. Application Data

[63] Continuation-in-part of Ser. No. 503,335, Apr. 2, 1990.

[51] Int. Cl.[5] ..... H05B 5/04; G05F 1/70

[52] U.S. Cl. ..... 323/212; 363/98; 219/10.77; 219/10.493

[58] Field of Search ..... 363/95-98; 323/212, 235, 244, 319; 219/10.77, 10.493, 10.75, 10.41; 373/145, 146, 147, 148, 149, 150

[56] References Cited

U.S. PATENT DOCUMENTS

| | | | |
|---|---|---|---|
| 3,419,792 | 12/1968 | Kasper et al. | 323/105 |
| 3,731,183 | 5/1973 | Johnson et al. | 323/24 |
| 4,145,592 | 3/1979 | Mizukawa et al. | 219/10.49 R |
| 4,209,683 | 6/1980 | Kiuchi et al. | 219/10.77 |
| 4,429,205 | 1/1984 | Cox | 219/10.77 |
| 4,467,165 | 8/1984 | Kiuchi et al. | 219/10.77 |
| 4,511,956 | 4/1985 | Dewan et al. | 363/49 |
| 4,672,301 | 6/1987 | Westfall et al. | 323/235 X |
| 4,780,803 | 10/1988 | Dede Garcia-Santamaria | 363/98 |
| 4,866,592 | 9/1989 | Fujii et al. | 363/98 |

*Primary Examiner*—Steven L. Stephan
*Assistant Examiner*—Emanuel Todd Voettz
*Attorney, Agent, or Firm*—Seidel, Gonda, Lavorgna & Monaco

[57] ABSTRACT

A control system for power delivered to an inductive load includes automatic control with a manual override for emergency situations. The system monitors the power delivered to the load and varies the power delivered to the inductive load by controlling the phase difference between the voltage and current delivered to the load. Feedback to the control system automatically controls the phase difference between voltage and current in response to the measured power delivered to the load. Provision is made for introducing an external signal into the feedback circuit, whereby the external signal supersedes the automatic control of the power delivered to the load.

6 Claims, 7 Drawing Sheets

PHASE DIFFERENCE CONTROL CIRCUIT FOR INDUCTION FURNACE POWER SUPPLY

RELATION TO OTHER APPLICATION

This application is a continuation-in-part of U.S. patent application Ser. No. 07/503,335, filed Apr. 2, 1990.

FIELD OF THE INVENTION

This invention relates to apparatus and method for controlling the power in an induction coil in an induction furnace. The invention varies the phase shift between load voltage and current, thus varying the apparent impedance of the load. The present invention further includes means for reducing power to the load in certain situations.

BACKGROUND OF THE INVENTION

Induction heating is a method of melting or otherwise heating a quantity of metal, not by applying heat externally, but by using the metal workpiece as its own heat source. An induction melting furnace generally includes a container for holding metal to be melted, an induction coil surrounding the container, and a power supply having an output circuit connected across the coil. In operation, the power supply creates current flow through the coil which, in turn, causes an alternating magnetic field to pass through the metal within the container. This field induces current flow in the metal so that the metal is heated internally by resistance heating.

In its electrical characteristics, an induction furnace is often visualized as equivalent to a transformer with a primary coil and a melt charge which behaves like a shorted secondary coil. The power released into the melt charge is proportional to the square of the current in the induction coil (primary coil):

$$P=I_{melt}^2R$$

where:

P=power;

$I_{melt}$=current in the melt bath; and

R=resistance of the melt.

Further, the current induced within the melt charge is equal to the current in the primary coil times the number of turns in the coil, or:

$$I_{melt}=nI_{coil}$$

where:

n=number of coil turns;

$I_{coil}$=current in the coil;

therefore $$P=n^2I_{coil}^2R$$

Since melt charges are almost always of metals having low resistance, providing high power to the melt charge requires either a high number of turns or a high current in the induction coil. These, in turn, yield poor efficiencies. Induction coils usually have low power factors.

To offset high inductance of the coil, it is usual to include a capacitor in the circuit, creating an RLC oscillating circuit. As is well known in the art, the amplitude of an alternating current in an RLC circuit can be controlled by varying the frequency of the current. A given RLC circuit will have a resonant frequency, at which the current amplitude will reach a maximum value. From an efficiency standpoint, to operate an induction furnace at its resonant frequency will maximize the energy transferred into the melt charge. However, to operate an induction furnace at its resonant frequency is impractical, as will be explained in detail below.

FIG. 1 is a block diagram of a typical induction furnace. External power is provided from a commercial source, and is usually in the form of 60 Hz AC from the power mains. The 60 Hz AC is rectified to provide high voltage DC. The DC is fed into an inverter 10, which usually utilizes silicon controlled rectifiers (SCRs) to "chop" the DC voltage into a square wave shape. The frequency of the "chopping" is determined by the frequency of the SCR firing. The speed at which the SCRs are fired thus controls the frequency of the resulting square wave. The square wave is then fed into the RLC circuit, in which the melt charge and induction coil may be regarded as a core disposed within an inductor L. As is well known, when alternating voltage is fed into an RLC circuit, a current having a sine-wave shape flows in the RLC circuit. The frequency of the voltage square wave and the resulting current sine-wave is directly controlled by the frequency of the SCR firing.

FIG. 2 shows a typical type of inverter (such as the inverter shown in FIG. 1), a "full-bridge" inverter 10, connected between a DC source 12 and the RLC circuit 14. (The $n^2R$ term at 14 represents the equivalent resistance of the RLC circuit, taking into account the number of turns n in the coil and the resistance R of the melt.) The full-bridge inverter 10 comprises four diodes 16 as shown, and four SCRs which operate in pairs 18*a*, 18*b*, and 20*a*, 20*b*, respectively. The SCRs operate as switches which complete a circuit when they are "fired" (i.e., rendered conductive) by an external control signal. In a fullbridge inverter, the SCRs 18*a*, 18*b* and 20*a*, 20*b* are turned on and off alternately in pairs at the desired frequency for the square wave. The arrows in FIG. 2 show the direction of current from the DC source 12 when SCRs 18*a*, 18*b* are fired and SCRs 20*a*, 20*b* are left open (i.e, nonconductive). SCRs 18*a*, 18*b*complete a circuit from which DC from source 12 flows through the RLC from left to right, as can be seen by the arrows. If, alternatively, SCRs 18*a* and 18*b* are in a non-conductive state, and SCRs 20*a* and 20*b* are fired, current will flow in the opposite direction through RLC 14, from right to left. As those skilled in the art will understand, an SCR, once fired, will conduct electric current as long as this current flows from the SCR's anode terminal to the cathode terminal. Should the current change direction, the SCR will block conduction and after a short period, usually 30–70 μsec, will turn off and again become non-conductive. This period is called "turn-off-time" or TOT, for short.

FIG. 3 shows a series of curves graphically describing the behavior of the current of FIG. 2 in the course of one and a half cycles of the inverter 10. With reference to curve 100, which describes the current associated with the inverter over time, and curve 110, which describes the power associated with the inverter over time, the action of inverter 10 can be summarized thus:

At $t_0$: One set of SCRs is fired. Positive current delivered to RLC, resulting in positive power dissipation in the load.

At $t_1$: Sine-curve behavior of RLC causes inverter current to become zero and then negative (shaded area 101*a*). Because current is negative while voltage is still positive, power to RLC becomes negative (shaded area 111*a*). This represents power not dissipated by the load. Reversal of current through first set of SCRs causes them to shut off.

At $t_2$: Alternate set of SCRs is fired, causing reversal of direction of voltage across the RLC. Because current and voltage are now both of the same polarity, power is again dissipated in the load.

At $t_3$: Inverter current crosses zero point and becomes positive (shaded area 101*b*). Because current is positive and voltage is negative, no power is dissipated (shaded area 111*b*).

At $t_4$: First set of SCRs is again fired. Current, voltage, and power are all positive and the cycle begins again.

The above summary will now be explained in detail. When DC is input into an RLC circuit, the circuit will "ring", and oscillations of voltage and current will result. The frequency of these oscillations depends on the specific values of the RLC components, including the properties of the melt charge inside the inductor. When SCR pair 18*a*, 18*b* is fired, current flows through the RLC circuit and the inverter in the direction of the arrows (FIG. 2). Current will gradually build up to its maximum value and then subside to zero, as illustrated in curve 100 of FIG. 3. The total energy passed from the DC source to the melt charge during the interval $t_0$–$t_1$, half a period for the oscillation of the RLC circuit, is:

$$E = \int_{t_0}^{t_1} vi\,dt > 0 \tag{1}$$

where v and i are voltage and current in the RLC circuit, respectively.

During this half-cycle, charge accumulates on the capacitor. At time $t_1$, the voltage on the capacitor is larger than the DC voltage and the capacitor begins to discharge, reversing the direction of the current along the path given by the arrows in FIG. 2. This reversal of current will cause SCRs 18*a*, 18*b* to turn off. After the turn-off-time (TOT) of SCRs 18*a*, 18*b*, this pair of SCRs will become non-conductive (although current can still return to the DC source through the diodes 16). For the period between $t_1$, when the capacitor begins to discharge, and $t_2$, when the other set of SCRs 20*a*, 20*b* is fired, the extra energy stored in the capacitor is returned to the DC source. The energy returned to the DC source between $t_1$ and $t_2$ is given by:

$$E = \int_{t_1}^{t_2} v(-i)dt < 0 \tag{2}$$

This reversal of current is illustrated in curve 100 of FIG. 3 as the negative portion of the curve between $t_1$ and $t_2$, encompassing shaded area 101*a*.

Normally, in a full-bridge inverter and many other types of inverter, the other pair of SCRs will be fired at some time after the turn-off-time of one pair of SCRs. When the other pair of SCRs 20*a*, 20*b* are fired, the DC from the source 12 flows through the RLC from right to left in FIG. 2, and the capacitor, begins to charge to the opposite polarity. Between points $t_2$ and $t_3$ in curve 100 in FIG. 2, the voltage and current relative to the DC source have the same polarity and therefore the energy transferred to the load is positive:

$$E = \int_{t_2}^{t_3} (-v)(-i)dt > 0 \tag{3}$$

In summary, energy is passed from the DC source to the metal charge (via the coil) when the voltage and current have the same polarity. This condition exists, in curve 100, between $t_0$ and $t_1$ and between $t_2$ and $t_3$. During the period $t_1$ to $t_2$, and between $t_3$ and $t_4$, energy is not being passed to the coil but is being returned to the DC source. These periods of negative energy are shown as shaded areas 101*a* and 101*b* in curve 100 and 111*a* and 111*b* in curve 110. Over the period T of an operating cycle (from $t_0$ to $t_4$), the power produced by the inverter can be determined as:

$$P = \frac{1}{T}\int_{t_0}^{t_4} VI\,dt \tag{4}$$

Assuming that the current is a sine wave and the voltage a square wave, as would be the case with such an inverter, the power passed from the inverter to the furnace will be equal to:

$$P = \frac{2}{\pi} VI\cos\phi \tag{5}$$

where:

V—inverter voltage ($=V_{DC}$ for a full-bridge inverter);

I—amplitude of inverter current;

f—frequency of SCR firing ($^1/T$)

$\phi = \frac{2t}{T}$ – phase shift between voltage and current;

t—time interval in which energy is being returned to the DC source.

The key to equation (5) is the relationship of the phase difference $\phi$ and the time interval t within each cycle in which energy is being returned to the DC source. From FIG. 3, it can be seen that for every cycle of inverter current ($t_0$ to $t_4$), there are two periods of equal duration in which power is returned to the source. These periods are the same as the periods between the zero crossing of the current and the zero crossing of the voltage in the inverter, which can be seen by a comparison of the zero crossings of curve 100 and curve 108. It is clear from equation (5) that, for $\phi$ between 0° and 90°, an increase in $\phi$ will cause a decrease in power. Thus, as $\phi$ increases, power passed to the furnace decreases. Maximum power transfer occurs when $\phi=0$.

However, a dangerous condition exists in an RLC circuit at resonance, in which $\omega_1$ equals $\omega_0$. Resonance is the point of maximum power transfer, when there is zero phase shift between voltage and current in the inverter. Zero phase shift means, in effect, that one set of SCRs is being turned on at exactly the same instant the other set is being turned off. This would be no problem if SCRs behaved as idealized switches, which open instantly. However, there is a finite period of time, the turn-off time (TOT) during which an SCR is still conductive after being turned off. If the phase shift is less than the TOT of the SCRs, all of the SCRs will be conductive at the same time, thus causing a short across the DC source. Thus, in order to avoid shorting out the power supply, the phase shift between voltage and current must always be greater than the TOT of the SCRs. This amounts to the same thing as preventing the frequency of the DC chopping from approaching the resonant frequency of the RLC. In order to operate safely, the frequency of SCR firing must always be safely below the resonant frequency of the RLC.

The engineering problem posed by this requirement is that the resonant frequency of an induction furnace does not remain constant but may vary considerably in the course of use. The physical properties of the melt charge, which acts as the inductor core, have a direct and significant effect on the resonant frequency of the furnace. These significant physical properties include the temperature of the melt charge at any given point of the heating operation, the amount of metal in the furnace at any given time, and the specific composition of the alloy being heated. These properties will vary widely with every situation, and even within the course of a single use of the furnace. It is not uncommon in induction melting to add cold metal to the furnace while a previously added batch is still heating, thus changing the mass, temperature, and crystal structure of the core almost instantaneously, and thereby almost instantaneously changing the resonant frequency of the inductor.

Of course, the SCR firing frequency could be kept extremely low so that the phase shift will always be greater than TOT, even at resonance. This approach is unacceptable because the power supply would become extremely inefficient. Because it is crucial that the input frequency be less than the resonant frequency, and because the resonant frequency may change so suddenly, a control system to control SCR firing frequency in response to new physical conditions in the furnace is required so that phase shift may be minimized for high efficiency yet never less than TOT to avoid shorting the power supply.

It is also theoretically possible to calculate the resonant frequency of an induction furnace at any given instant, given the instantaneous temperature, the mass of the core, and physical properties of the core, and thereby change SCR firing frequency as required but as a practical matter these parameters are too difficult to measure, and are not suitable as inputs to a control system.

One common attempt at solution to this problem is varying the inverter frequency electronically, using voltage-controlled oscillators. The voltage-controlled oscillators generate pulses with a frequency proportional to a control voltage produced by a closed-loop circuit which measures the output power and compare it with a preset desired value. However, this method has a major drawback in that a frequency control system generally cannot adapt to sudden changes in electromagnetic properties of the furnace. If a cold charge is dropped into the melt, the system is likely to encounter the new resonant frequency before the frequency can change, and the inverter will crash. Special protection circuits to detect such a condition are cumbersome and do not work well.

In contrast, the present invention controls power delivered to the induction coil by varying the phase difference between current and voltage in the coil in response to the resonant frequency of the load. The present invention does not directly vary the frequency of the inverter AC voltage. Instead, the present invention monitors the zero-crossings of the current in the inductor, and adjusts the time delay before the SCR's are fired in such a way that the output power level is maintained and that there will always be at least a minimum phase shift $\phi$ between current and voltage. Although the frequency of the DC voltage may vary in the course of use of this method it is important to understand that the method merely reacts to the resonant frequency in the RLC load circuit under a variety of conditions.

SUMMARY OF THE INVENTION

A control system for power delivered to an inductive load includes automatic control with a manual override for emergency situations. The system includes means for monitoring the power delivered to the load and means for varying the power delivered to the induction load by controlling the phase difference between voltage and current delivered to the load. Feedback means automatically control the phase difference between voltage and current in response to the measured power delivered to the load. Means are further provided for introducing an external signal into the feedback means, whereby the external signal supersedes the automatic controlling of the power delivered to the load.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 3:
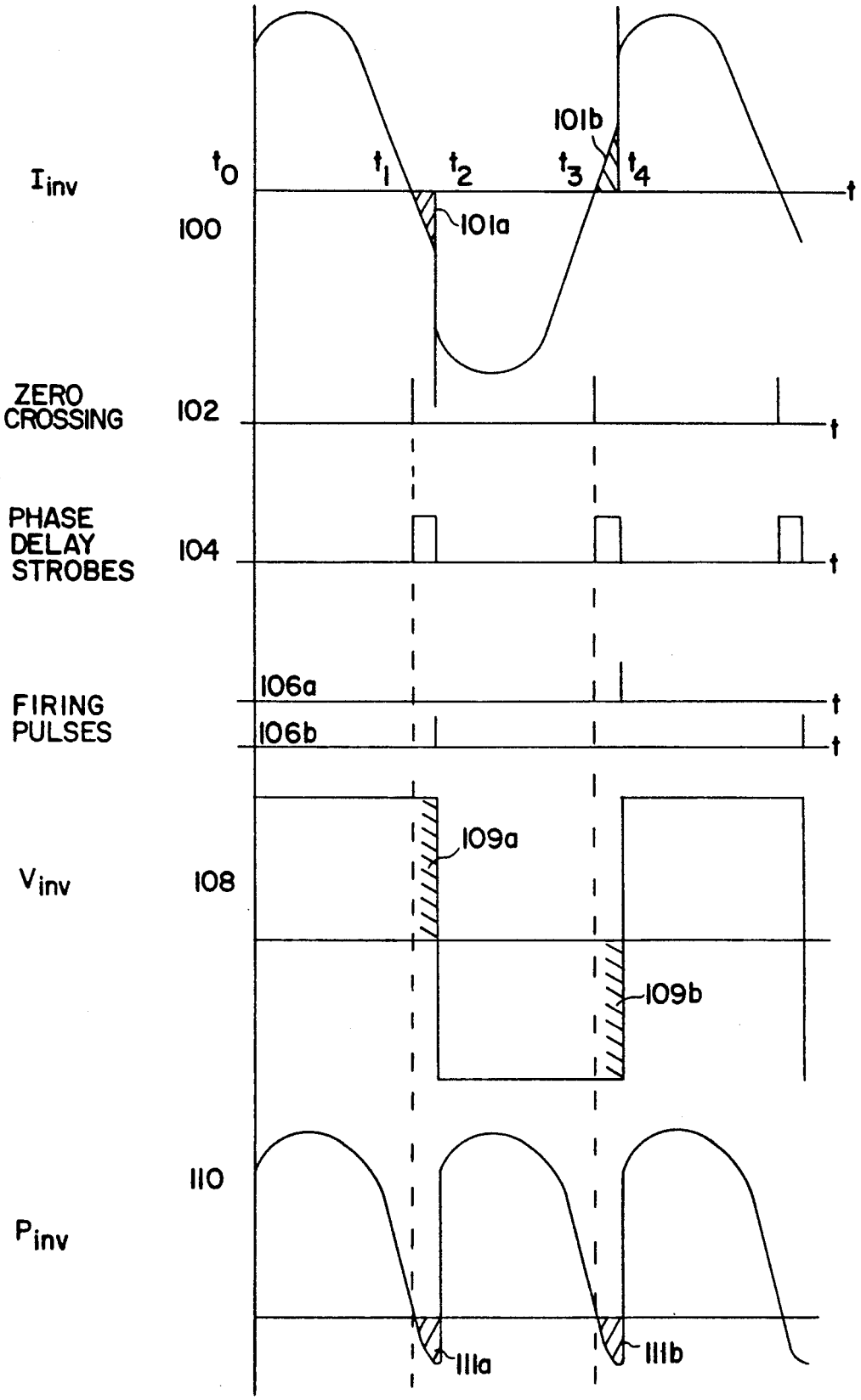
FIG. 3 is a series of waveforms present at various points in the control system of the present invention.
Figure 4:
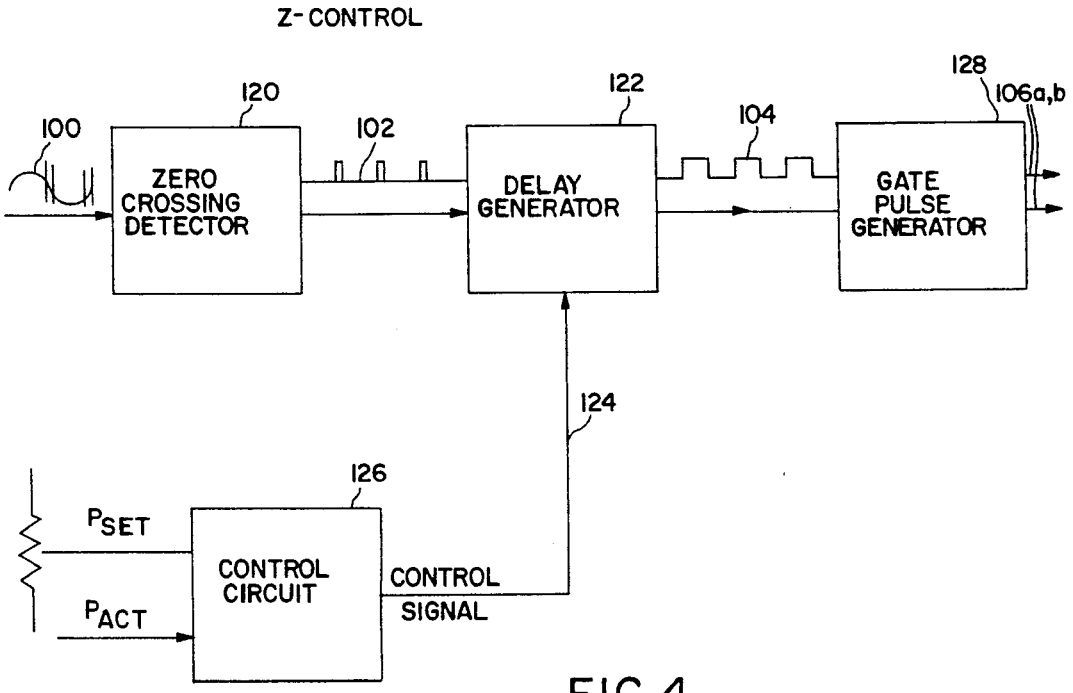
FIG. 4 is a simplified block diagram showing the basic elements of present invention.

FIG. 4 is a block diagram showing the basic elements of the invention. These elements may be embodied electronically in any form, such as by analog circuit, digital circuit, or microprocessor. An analog embodiment of the present invention is described below. FIG. 4, together with the waveforms of FIG. 3, illustrate the general principles by which the control system of the present invention controls power passing from the power supply to the melt charge.

Figure 1:
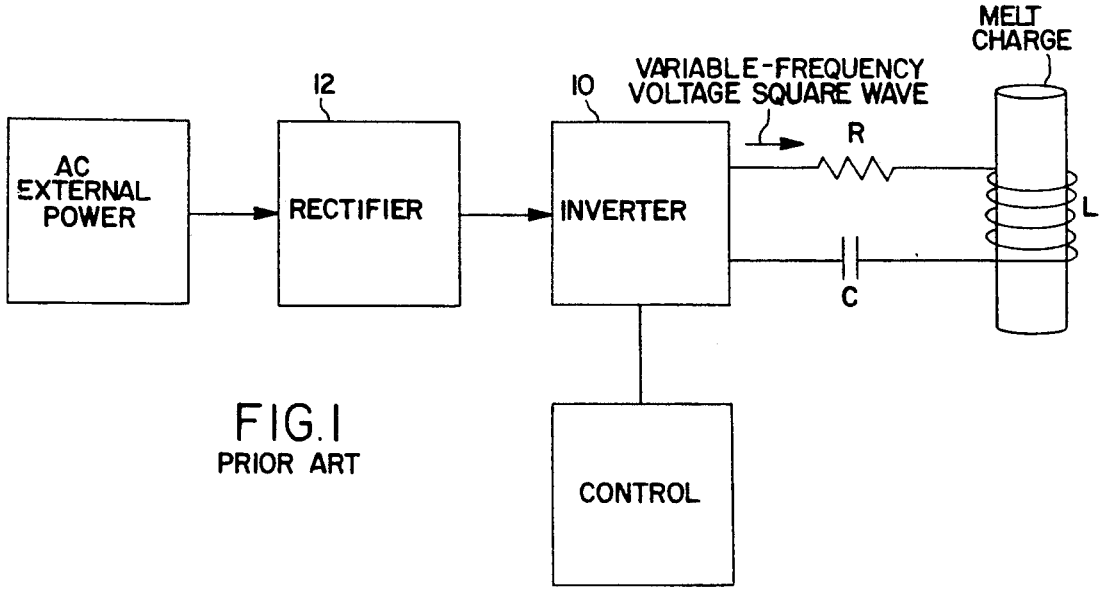
FIG.1 PRIOR ART
FIG. 1 is a simplified schematic diagram showing the general layout of the power supply for an induction heater according prior art.
Figure 2:
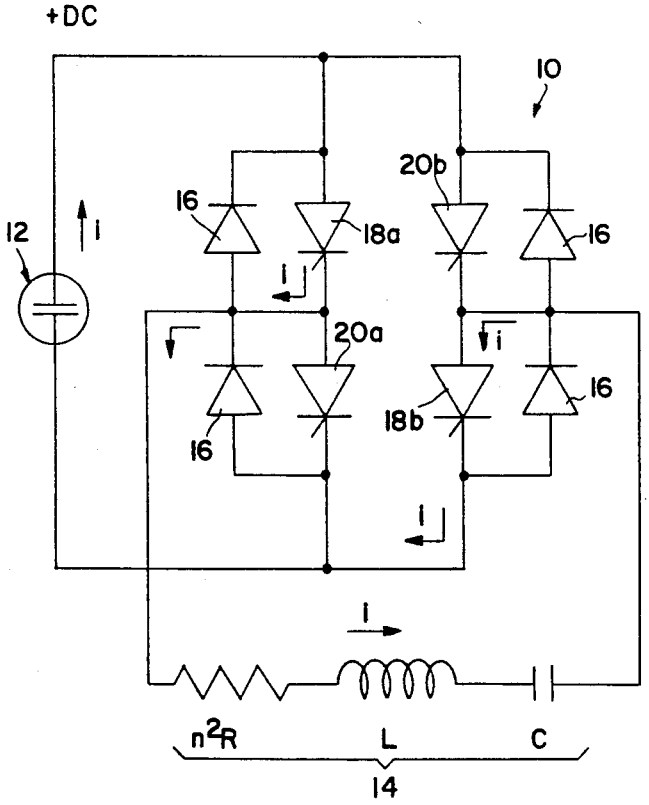
FIG.2 PRIOR ART
FIG. 2 is a schematic diagram of a full-bridge inverter between a DC source and an RLC load, according to the prior art.

Curve 10 in FIG. 3 represents the behavior of the current in the RLC load in response to the square-wave voltage. A first set of SCRs, as in FIG. 2, is fired at $t_0$.

When there is a flow of energy into the RLC load, as between points $t_0$ and $t_1$, voltage accumulates on the capacitor and power is transferred from the power supply to the melt charge. At point $t_1$, following the natural sinusoidal behavior of current in an RLC, the current crosses a zero point and becomes negative (i.e., changes direction), as seen in the shaded area marked 101. A negative current flow causes the SCRs to turn off. During the turn-off period and before firing of the other set of SCRs, energy will be flowing back to the DC source instead of passing to the melt charge.

The point of zero crossing of the current in the RLC is thus important because the zero crossing marks the point at which energy begins flowing back to the DC source. Energy will flow back to the source until the SCRs turn off. Once the SCRs have turned off, the other set of SCRs may safely be turned on. By turning on the other set of SCRs immediately after the first set has turned off, efficiency is maximized while preventing a short circuit.

The current in the RLC is monitored by a zero-crossing detector, shown as box 120 in FIG. 4, which generates a strobe pulse at every zero crossing of the current in the RLC. This strobe pulse is shown as waveform 102 in FIGS. 3 and 4. As can be seen in FIG. 3, each strobe is synchronous with the zero-crossing of curve 100.

Zero-crossing strobe pulses 102 are then fed into a delay generator 122. Delay generator 122 produces a square pulse of a fixed duration in response to each incoming strobe pulse 102, as shown by waveform 104. This duration may be varied by a control signal 124.

Control signal 124 is produced by control circuit 126 in response to a difference signal, which is preferably but need not be related to the power associated with the RLC. Any parameter relevant to the particular job, such as voltage or frequency, may also be used as the control parameter. Considering power as the relevant parameter to be controlled, the control circuit includes means for comparing the actual measured power in the RLC at a given time with a value preset by the operator. Typically, the preset power value will be chosen so as to prevent the power in the RLC from exceeding a safe level. The control circuit 126 produces a difference signal related to the instantaneous difference between power associated with the RLC and the preset value, and this difference signal is used to operate the control signal 124 sent to the delay generator 122.

Generally if actual power detected in the RLC exceeds a preset value, the control signal causes the delay generator to increase the duration of each square pulse in waveform 104, causing an increase in the time between the zero crossing of current in the RLC and the firing of the other set of SCRs. An increase in this period means an increase in the time within each cycle during which energy is flowing back to the DC source, and therefore reducing the total amount of power passing to the melt charge within each cycle.

The output of the delay generator is sent to a gate pulse generator 128. Gate pulse generator 128 fires the appropriate pair of SCRs in response to the trailing edge of each square pulse of waveform 104. Because gate pulse generator 128 fires the pairs of SCRs in the bridge alternately, the firing pulses shown as waveform 106 in FIG. 3 are split so that every other pulse appears on one of two lines. Waveform 106*a*, for example, would fire SCRs 18*a*, 18*b* in the bridge of FIG. 2, and waveform 106*b* would fire the SCRs 20*a*, 20*b*. The alternate firing of the pairs of SCRs in the full-bridge inverter causes the "chopped", or square-wave, voltage as shown in curve 108.

Although a full-bridge inverter is used to describe the principle of power control, the control system of the present invention can be used with any type of inverter, such as a half-bridge inverter or a digital device, wherein the sign changes of the chopped DC voltage can be externally controlled. With a digital or microprocessor-controlled inverter, it may not be necessary to split the firing pulses 106*a*, 106*b* into two trains, but the general principle of controlling the delay between the zero-crossing of the current and the sign change of the voltage is the same.

Comparing waveforms 100, 108, and 110 in FIG. 3, the method of power control of the present invention can be clearly seen. As curve 100 represents the current in the inverter over time, and curve 108 represents the voltage in the inverter over time, curve 110 represents power over time ($P=VI$) which is simply the product of curves 100 and 108. Between $t_1$ and $t_2$, after the zero crossing of current and before the firing of the alternate pair of SCRs, the current and voltage have opposite polarities. After $t_1$, current is negative while voltage remains positive, as can be seen in shaded area 109*a*. The product of a negative current and positive voltage yields a "negative" power, which is illustrated as shaded area 111*a* in curve 110 and which represents energy returned to the source. Similarly, between $t_3$ and $t_4$, the current is positive while the inverter voltage remains negative, as can be seen in shaded area 109*b* of curve 108. With a positive current and negative voltage, power will also be "negative", as seen in shaded area 111*b*. Power will be positive during those periods when current and voltage have the same polarity, whether positive or negative, representing energy transferred to the load.

However, when the voltage and current are of opposite polarity, power is "negative", i.e., no power is being transferred to the load and, instead, power stored in the RLC circuit is returned to the source. The duration of these periods of negative power is the same as that of each of the phase delay strobes in square pulse waves 104. By varying the duration of these delay strobes 104, the phase difference between voltage and current, and therefore the power, is directly regulated.

Figure 5:
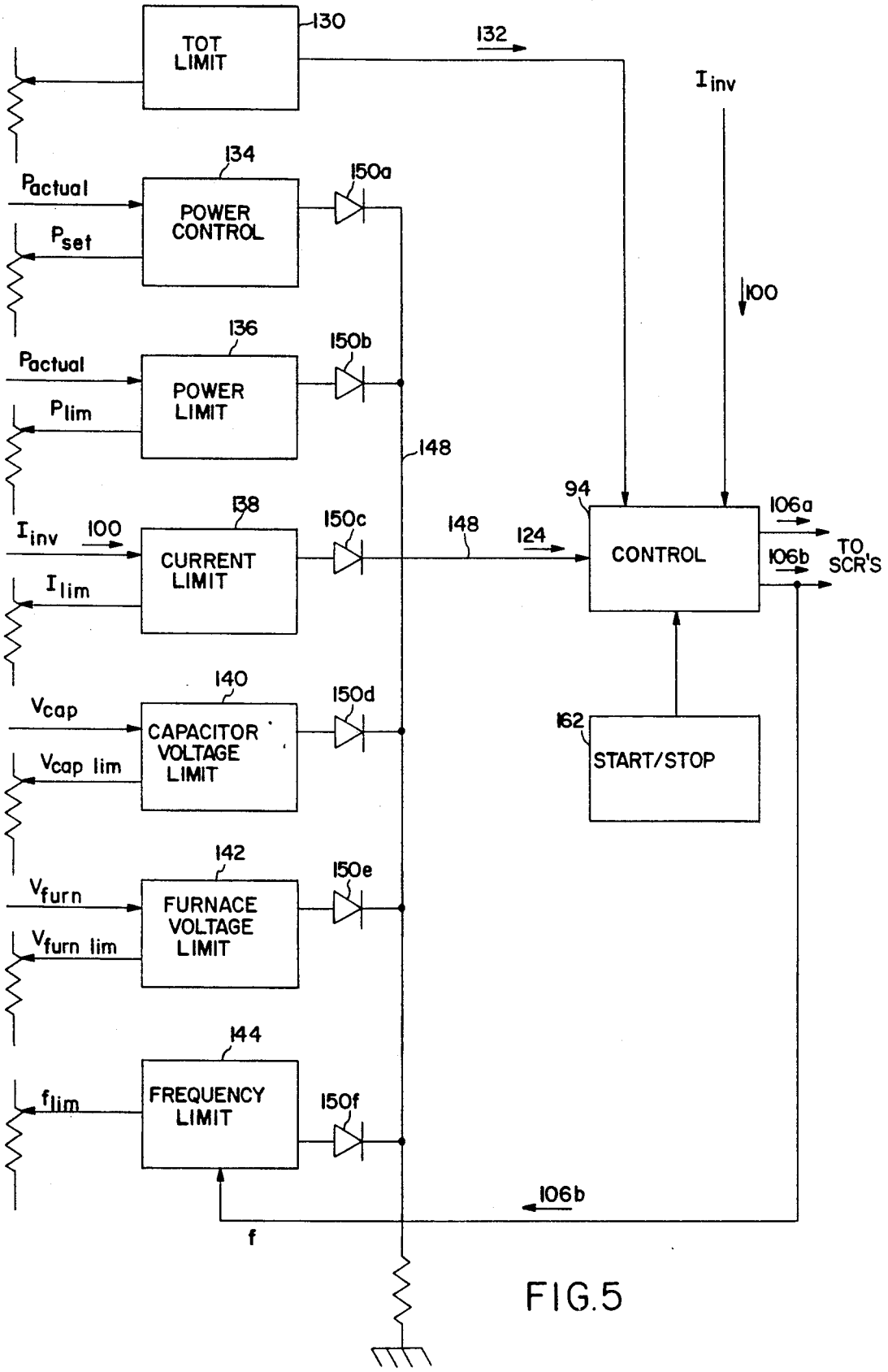
FIG. 5 is a simplified block diagram showing one embodiment of the invention.

FIG. 5 is a block diagram showing one embodiment of the invention, wherein the limits to various parameters are set by analog means and the firing pulses are split between two channels.

The zero crossing detector 120, delay generator 122 and gate pulse generator 128 are shown as one module 99 labeled "CONTROL". Input into the control module 99 are the inverter current (waveform 100 in FIG. 3), control signal 124 (as in FIG. 4), a start/stop signal, and a TOT limit signal 132, which will be explained below. Output from control module 99 are two lines which carry the split-channel firing pulses 106*a*, 106*b*.

In the embodiment shown in FIG. 5, the control signal 124, which controls the delay generator 122 in control module 99, is a combination of a number of difference signals, each difference signal corresponding to a parameter of the circuit. These signals are derived from individual modules: power control module 134, power limit module 136, current limit module 138, capacitor voltage limit module 140, furnace voltage limit module 142, and frequency limit module 144. Each of the modules monitors a parameter of the circuit and compares it with a preset value for that parameter to produce a difference signal. The difference signal is passed through a common line 148, each individual difference signal passing through one of the diodes 150*a–f*. The combined difference signal on line 148 forms control signal 124. The individual modules for each parameter preferably comprise active circuit elements, such as comparators.

The power control module 134 may accept as inputs either a direct power measurement, or may accept separate inputs of voltage and current. In the latter case, the separate voltage and current inputs are multiplied to obtain a power signal. The input flexibility of the power control module 134 permits the control system of the present invention to be installed on pre-existing equipment. Some equipment is adapted for direct measurement of power, while other types of equipment have separate lines for voltage and current. When separate inputs of voltage and current are used, it is preferable to filter both signals through separate differential amplifiers to remove common-mode noise. Current and voltage may be multiplied with an analog multiplier and then integrated with an integrator to yield a power signal. The power signal is then amplified and compared to the set power signal determined by the operator. The set power signal is generated on an external potentiometer. The set power signal is filtered to dampen quick changes by the operator. The set power signal and the actual power signal (whether directly measured or obtained by multiplying voltage and current) are compared in a differential amplifier/ integrator within module 134, which produces the resultant error signal on common line 148.

While the power control module 134 maintains the power near a preset level, power limit module 136 prevents the power in the load from exceeding a preselected amount. The power limit module 136 monitors load power in the same ways as power controller 134, and compares it to a power limit signal set by the operator through an external potentiometer. The actual power at a given time will be either lower than the limit signal, producing a negative difference signal, or greater than the limit signal, producing a positive difference signal. In the power limit module 136, the negative difference signal is ignored. The power limit module 136 produces a difference signal only when the measured power exceeds the preset power limit.

Current limit module 138 receives as its input the current from the inverter (waveform 100 in FIG. 3). The input is filtered to provide an average inverter current signal which is compared with a preset current limit. As with the power limit signal, actual current values below the preset limit are ignored, and a difference signal is produced only when inverter current exceeds the preset limit.

Capacitor voltage limit module 140 measures the voltage on the capacitor, rectifies and filters this voltage to determine an average voltage signal, and then compares the average voltage signal to a preset limit, producing a difference signal if the actual voltage exceeds the preset limit. Furnace voltage limit module 142 performs the same function, except that it monitors the voltage associated with the inductor coil.

Frequency limit module 144 receives as an input the firing pulses 106*a* or 106*b* generated by the control module 99. Two pulses are produced for each cycle of the DC square wave one on each channel, and the pulses on one of the channels will have the same frequency as the RLC load. The output of one of the channels is monitored by the voltage frequency limit module 144, where the input pulses are filtered to produce a DC voltage directly proportional to the frequency of the firing pulses and, hence, the frequency of the inverter. This DC voltage is compared with a preset limit, and, as with the other limit modules, a difference signal will be produced only when the measured frequency exceeds the preset limit.

It will thus be appreciated that, in addition to a power control module 134 which controls the power associated with the RLC to a desired value, the invention includes a number of limit modules 136–144, which monitor the power and other parameters to prevent each of these parameters and the power from exceeding a preset limit. These other parameters are controlled independently depending on a particular situation. For example, the capacitor in the RLC load will typically have specific maximum allowable voltage and frequency limits peculiar to the capacitor which may not be accounted for by regulating the power alone. Thus, although only power is actually controlled, individually limiting the other parameters is important as well.

In addition to control signal 124, which represents a combination of the control signals from all of the modules, the control module 99 also receives as an input a TOT limit signal 132 which is produced by a TOT limit module 130. The TOT, or "turn-off-time", limit represents a minimum difference signal corresponding to a minimum period of negative energy flow within each cycle of the inverter to prevent it from shorting. As mentioned above, if the alternate pair of SCRs is fired before the turn-off-time (TOT) of the first pair of SCRs, the inverter will short and crash. The TOT limit module 130 will provide a minimum difference signal so that the alternate pair of SCRs will always fire after the turn-off-time of the first pair of SCRs, when the first pair of SCRs have returned to the OFF state.

The control module 99 also receives inverter current as a direct input to monitor the zero-crossing points of the inverter current. Control module 99 also has provision for start/stop means 162, which is explained in detail below.

Figure 6:
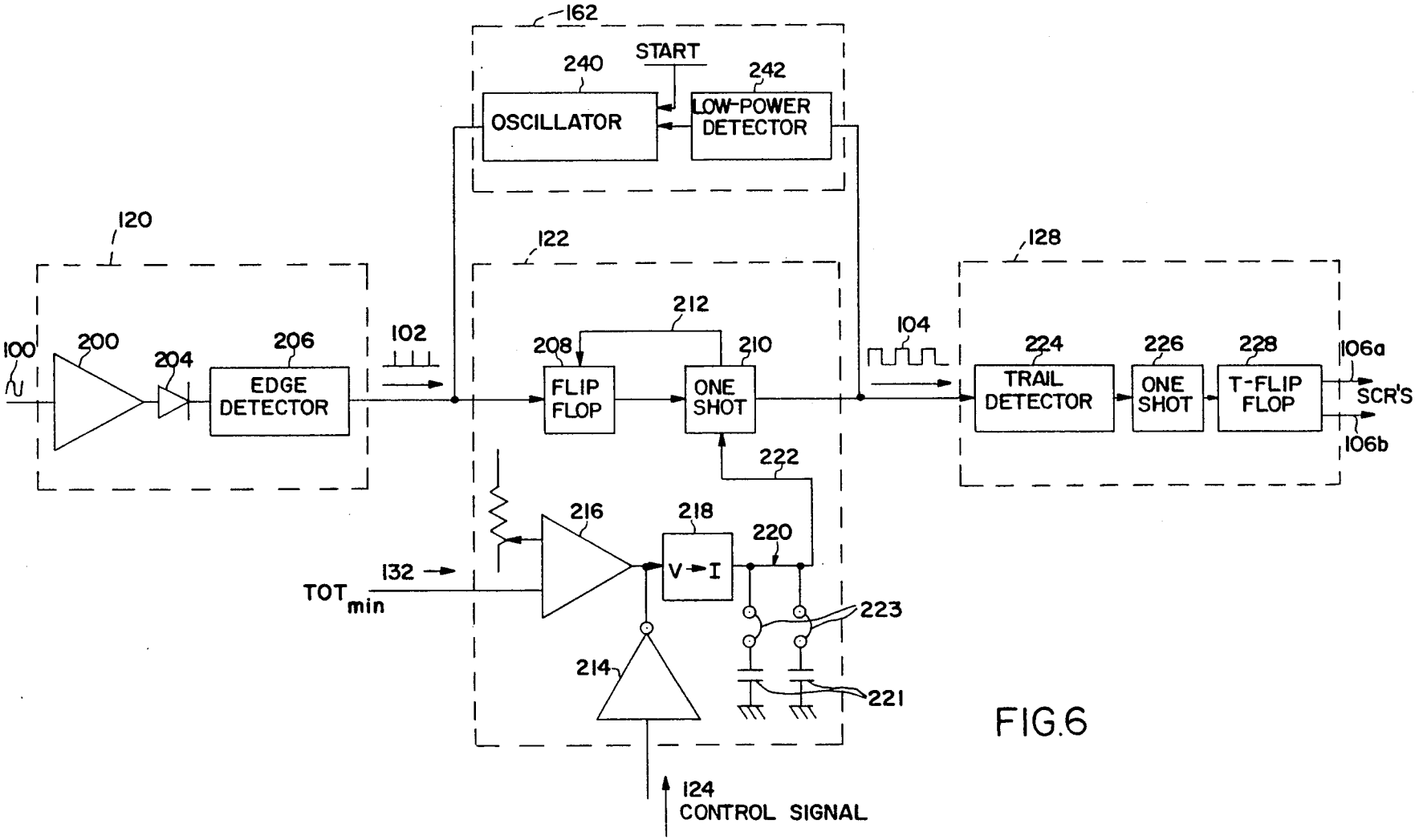
FIG. 6 is a block diagram showing the elements of the invention in FIG. 4 in greater detail.

FIG. 6 is a detailed diagram showing the primary internal portions of zero crossing detector 120, delay generator 122, and gate pulse generator 128. In this embodiment, zero crossing detector 120 comprises a comparator 200, a diode 204, and an edge detector circuit 206. Waveform 100, representing the current in the RLC load, is fed into comparator 200. Comparator 200 outputs a constant positive voltage when the incoming current is greater than zero, and an equal amplitude but negative constant voltage when the incoming current is less than zero. The output of comparator 200 is thus a square wave voltage. The negative portion of this signal is cut off by diode 204 and the resulting square wave, varying between a positive voltage and zero, is fed into an edge detector 206, which may take the form of a Schmitt trigger. Each edge of the square wave corresponds to a zero crossing of the current. Edge detector 206 produces a strobe upon every leading and trailing edge of the square wave. These strobes become waveform 102 and are passed to the delay generator 122.

Delay generator 122 comprises flip-flop 208, one-shot 210, voltage-to-current convertor 218, and a plurality of timing capacitors 220. Zero crossing strobes 102 are entered into flip-flop 208, which passes the signal to one-shot 210. One-shot 210 preferably comprises a clamping line 212 connected to flip-flop 208, which will block further inputs to flip-flop 208 for a delay period of a certain duration. This blocking feature assures that no false zero crossing signal will trigger the flip-flop 208 at an inappropriate time.

Control signal 124 is input into inverter 214, and the inverted signal is combined with a preselected minimum turn-off-time signal 132 which, as explained above, provides a minimum difference signal to ensure a minimum delay time between zero crossing and firing of the SCRs. The minimum turn-off-time signal 132 is passed through comparator 216, which allows for fine adjustments. The combined control signal (minimum turn-off-time signal 132 and the control signal 124) is entered into a voltage-to-current converter 218, which produces a current proportional to the voltage of the combined control signal. This current charges timing capacitors 220. Timing capacitors 220 may be in the form of a series of capacitors 221, selected by jumpers 223 for proper frequency range. The greater the voltage of the control signal entered into converter 218, the greater the output current, and the faster the timing capacitors will charge. The timing capacitors 220 are connected to one-shot 210 through line 222. Upon receiving a signal from flip-flop 208, one-shot 210 it will produce a positive voltage, and will also unclamp line 222, allowing timing capacitors 220 to charge with current from convertor 218. The positive voltage output will be turned off only when the charge on timing capacitor 220 reaches a threshold amount. As the rate of charging of the timing capacitors depends on the current produced by converter 218, which in turn is proportional to the control signal, the length of time one-shot 210 will output a positive voltage is directly dependent on the control signal 124. This positive voltage forms the delay pulses 104, which are sent to gate pulse generator 124.

Gate pulse generator 128 comprises a trail detector 224, a one-shot 226, and a T flip-flop 228. Trail detector 224 detects the trailing edge of each of the delay pulses 104. The trailing edges of delay pulses 104 indicate the times at which a pair of SCRs should be fired. Trail detector 224 produces strobes which trigger one-shot 226, which produces standard SCR firing pulses. These firing pulses are divided into two strings by T flip-flop 228. Every strobe pulse entered into T flip-flop 228 alters the state of the T flip-flop 228, which in turn alternately fires one pair of SCRs. Thus, with every trailing edge of delay pulses 104, a firing pulse 106*a* or 106*b* is output from alternate outputs of the T flip-flop 228.

In using the control system of the present invention, there is a danger of causing a short in the inverter when the apparatus is being started or stopped. A number of cycles will be required before the control system adapts to the frequency associated with the RLC load. Control module 99 thus includes means 162 for safely starting and stopping the control system by means of an oscillator 240 which initiates simulated zero crossing strobes to the delay generator 122. On starting, the simulated strobes are generated while inhibiting the power reference voltage entered into power control module 134. In this way, inverter operation is simulated before power is actually passed through the inverter to the RLC load. By starting the control system in advance, there is no danger of a short while the inverter "finds" the appropriate operating frequency for a particular melt charge. To stop the apparatus, the start/stop means 162 detects a low power to the inverter by means of detecting delay pulses 104 of a certain duration associated with a low level of power. At low power, the oscillator 240 is once again triggered to initiate artificial zero crossing pulses to delay generator 122, and the power is allowed to ramp down to the low idle frequency produced by the oscillator 240 so that it may be safely stopped.

Figure 7:
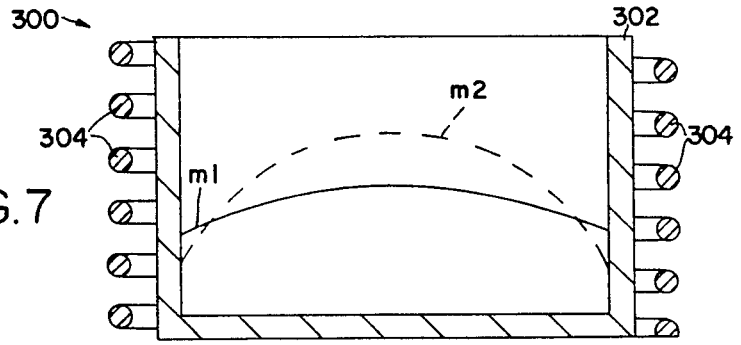
FIG. 7 is a simplified cross-sectional view of an induction furnace liquid metal therein.

A common occurrence when an automatic control system such as that just described is used for induction melting is physical oscillation of the melt. Such oscillation tends to occur when maintaining light metals such as aluminum at a constant temperature, or when the metal bath is shallow. As already known, when a metal charge to be melted is disposed within the magnetic field of the induction coil, a force is exerted on the charge at right angles in the direction of the field. This force is exerted whether or not the metal charge is ferromagnetic. When the metal charge is in a molten, or liquid, state, the force from the induction coil causes the liquid metal to physically circulate in the melting vessel. The circulation in turn causes what is known as a "pinch effect", resulting in a convex meniscus on the top surface of the melt. The meniscus causes a redistribution of the mass of the liquid metal relative to the induction coil, changing the magnetic characteristics and the apparent impedance of the load the liquid metal presents to the inverter. FIG. 7 shows a typical shallow induction furnace 300, including a crucible 302 surrounded by the turns 304 of an induction coil. When an automatic-control system such as that just described is used to adjust the power associated with the inverter, the resulting meniscus M1 will tend to change the apparent load presented to the inverter by the metal in such a manner that the system will increase power to the induction coil in response. However, the added power will result in larger forces on the metal, increasing the convexity of the meniscus, such as to position M2, shown in phantom in FIG. 7. When the height of the meniscus is too great, the metal will no longer be able to support itself in the area of meniscus M2, and the meniscus will collapse. The creation of an increasing meniscus followed by its collapse will result in oscillation of the liquid metal. In extreme cases, such oscillation will cause dangerous splashing of molten metal from the furnace, and may lead to oscillation-induced physical damage to the furnace.

In order to prevent this dangerous oscillation of the melt, the preferred method is to interrupt the control loop, by which a change in the physical shape of the melt causes the automatic control system to deliver more power to the load. It is not necessarily desirable to simply reduce power delivered to the load, in that a mere reduction in power may cause the melt to cool prematurely, which may adversely affect the desired melting process or damage the furnace. It should be kept in mind that the oscillation is caused not by a mere high level of power delivered to the load, but the interaction of the changing shape of the melt with the automatic control system. The oscillation is avoided in the invention by decoupling the feedback loop of the automatic control system.

Figure 8:
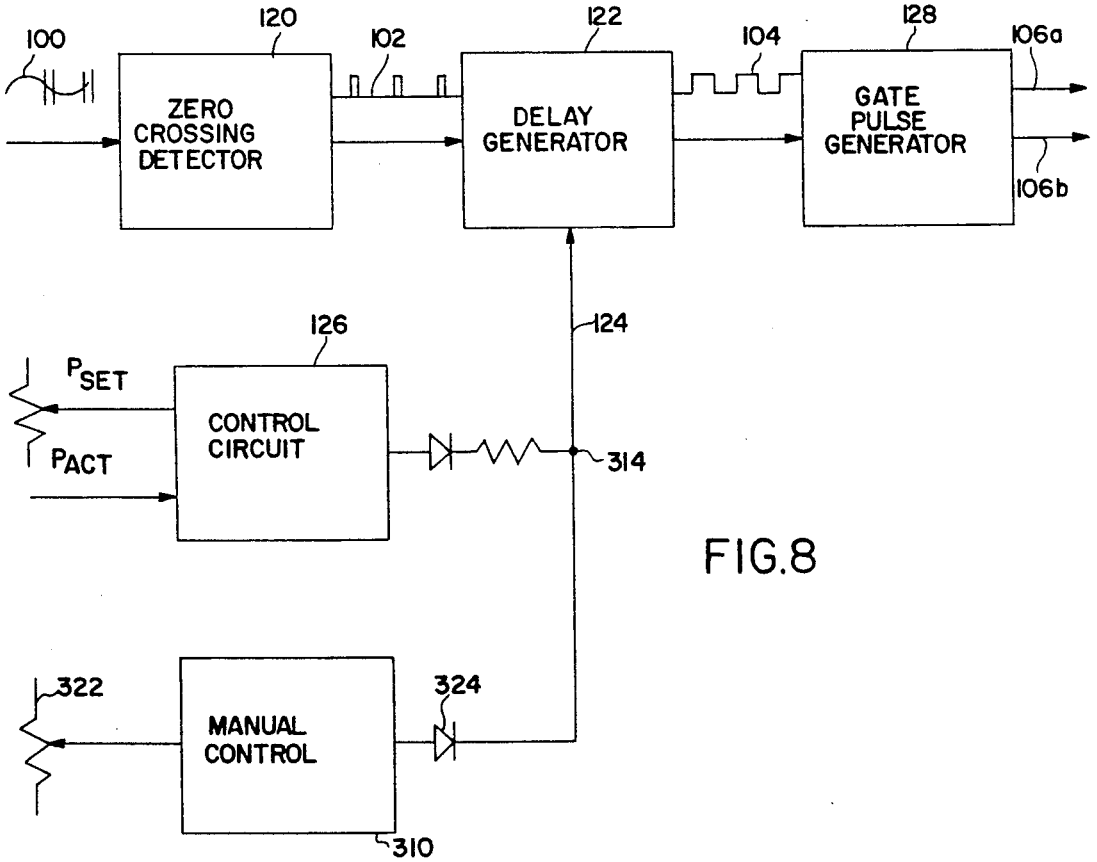
FIG. 8 is a simplified block diagram showing the basic elements of an embodiment of the present invention having a safety feature.

FIG. 8 shows a modified version of the control system of FIG. 4. Ordinarily, control circuit 126 accepts as an input the actual measured power delivered to an inductive load at a given time, and compares the measured power level to a preset power level, as well as preset maximum values for other parameters such as voltage, current and temperature, as described above. The control circuit 126 adjusts the power delivered to the load based on the control signal associated with these various parameters by sending through line 124 a voltage to the delay generator 122. As described above, the magnitude of the voltage on line 124 will have an effect on the duration of the delay strobes generated by delay generator 122. In the embodiment of the invention shown in FIG. 8, the control circuit 126 shares line 124 with a manual control circuit 310. Manual control circuit 310 accepts as an input the voltage from potentiometer 322, which is adjusted manually by an operator upon observing a potentially dangerous oscillation in the furnace. The output of manual control 310 is a non-time-varying signal which is connected through diode 324 to line 124 at node 314. Thus, the voltage from manual control 310 can be substituted for the regular control voltage from circuit 126, and therefore the manual control 310 can override the automatic control circuit 126 in influencing the delay generator 122.

Figure 9:
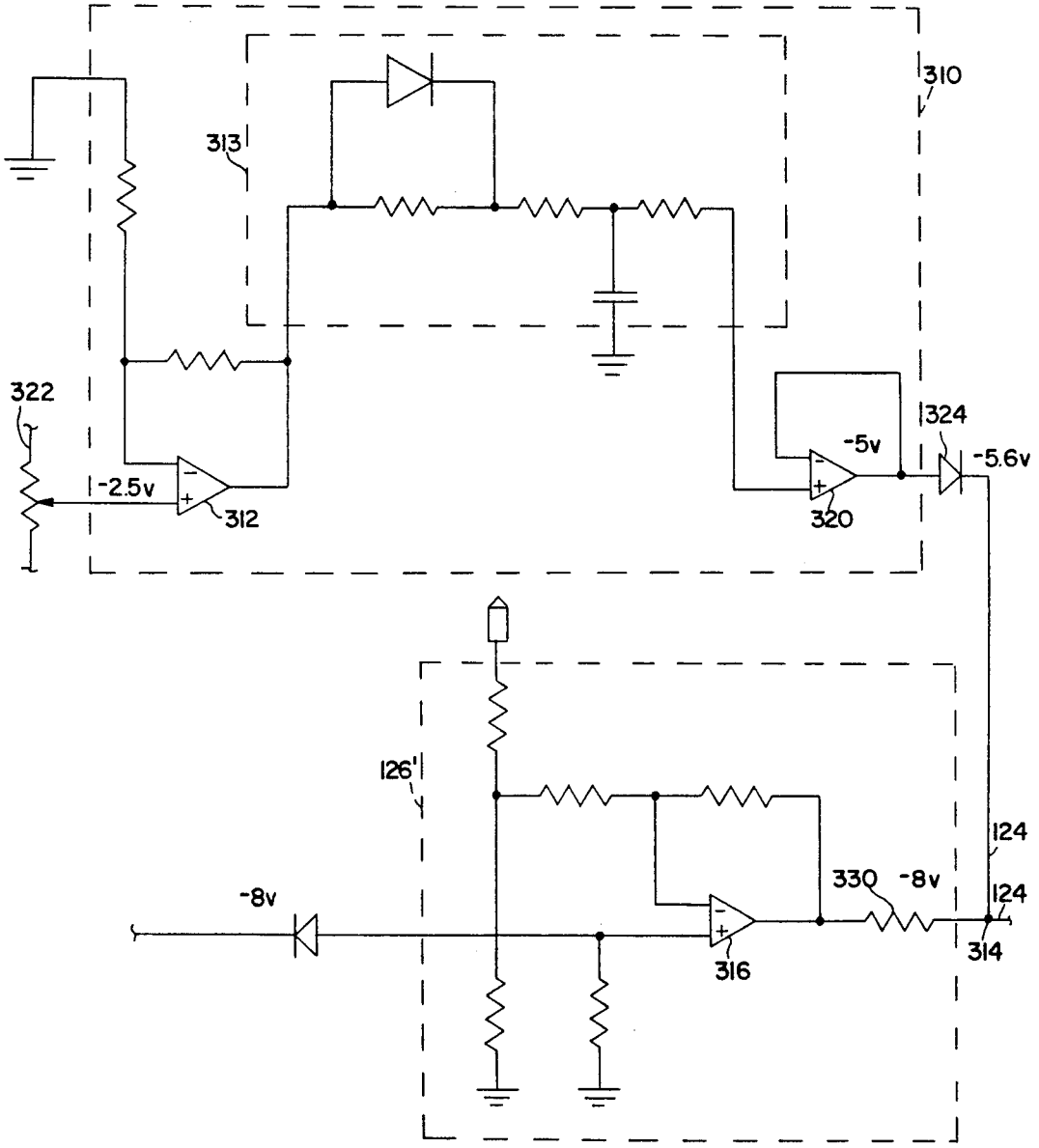
FIG. 9 is a schematic circuit diagram showing the preferred embodiment of the safety feature of the present invention.

FIG. 9 shows a schematic of a preferred circuit for the manual control feature, along with illustrative voltage values for various points in the circuit. Circuit 126' represents a portion of the control circuit 126 in FIG. 8 which influences delay generator 122 automatically based on direct measurement of power parameters.

For purposes of illustrating operation of the embodiment shown in FIG. 9, it is assumed that typical values for the control signal are on the order of small negative dc voltages. A typical value of the voltage signal on line 124 is given as −8 volts. In this embodiment, the negative voltages of the control system are inverted (with circuit elements not shown in FIG. 9), and the resulting positive voltages used to charge the charging capacitors (such as 221 in FIG. 6). In this arrangement, an increasingly negative voltage on line 124 will be inverted to create an increasingly positive voltage applied to the charging capacitors. An increasing positive voltage on the charging capacitors will cause the charging capacitors 221 to charge more quickly. The more quickly the charging capacitors charge, the shorter the delay time generated by the delay generator 122. As the time delay between voltage and current being delivered to the load becomes shorter, more power is delivered to the load. As the voltage of the control signal becomes more negative, more power is delivered to the load; as the voltage of the control signal becomes less negative, less power is delivered to the load. Although activation of manual control circuit 310 may result in a reduction of power delivered to the load, as will be explained below, it should be emphasized that reduction of power to the load per se is not the function of the manual control circuit 310. Rather, the main purpose of manual control circuit 310 is to override and decouple the feedback loop of control circuit 126.

Manual control circuit 310 includes an amplifier 312, damper circuit 313, and follower 320. Amplifier 312 is preferably an operational amplifier arranged as an inverting adder with its negative input connected to ground and its positive input connected to potentiometer 322. The resistances associated with the amplifier 312 are typically chosen to give the amplifier 312 an appropriate gain, such as 2, of the input voltage from the potentiometer 322. The output from amplifier 312 is then sent through damper circuit 313, which prevents too-rapid increases in the voltage signal. Damper circuit 313 is preferably in the form of a passive low-pass filter, as shown. From damper circuit 313, the amplified voltage signal from amplifier 312 is passed through follower 320, and then through diode 324 to node 314.

The control circuit 126', a portion of the general control circuit 126, accepts as an input a negative voltage related to the actual measured power being delivered to the load, and sends a voltage signal through to the charging capacitors. Once again, the more negative the signal from circuit 126', the faster the charging capacitors will charge. This will result in a shorter delay time between voltage and current delivered to the load and, hence, more power delivered to the load. In the present example a typical voltage signal for a desired power delivered to the load is given as −8 volts. Circuit 126' typically includes an amplifier 316 and a high-resistance resistor 330. The purpose of the amplifier is to adjust the gain of the voltage signal to be suitable for charging the charging capacitors at the desired rate, while the high resistance 330 permits the voltage of node 314 to be different from the output voltage of amplifier 316. The diode 324 adjacent manual control circuit 310 and high resistance 330 in control circuit 126' isolate circuits 310 and 126 from each other so that the least negative of the voltages output by control circuit 126' and manual control 310 will be present at node 314.

Between node 314 and the delay generator 122 there is preferably a high impedance created by op amp 214 associated with the charging capacitors in delay generator 122 (see FIG. 6). This high impedance, combined with the high resistance resistor 330 associated with control circuit 126' and diode 324 associated with manual control 310, means that the delay generator 122 will respond only to the least negative of the voltage signals of control circuit 126' and manual control 310. Thus, when the voltage from control circuit 310 is less negative then the voltage from control circuit 126', diode 324 will be forward-biased, and the less negative voltage from manual control circuit 310 (plus the voltage drop across diode 324) will appear at node 314 as the input to delay generator 122. In the opposite situation, when the voltage signal output from circuit 126' is less negative than the output from manual control circuit 310, diode 324 will be reverse-biased and will no longer conduct, and the voltage at node 314 will be the output from control circuit 126'. Very little voltage drop occurs across the resistor 330, since node 314 is connected to the input of op amp 214 (see FIG. 6), which has a very high impedance.

FIG. 9 gives illustrative voltage values at various points on the circuit. A typical voltage signal through control circuit 126' is −8 volts, but the voltage will vary depending on the desired power. In a situation where the voltage signal from control circuit 126' is to be superseded, such as when an operator observes oscillation of the melt, the operator adjusts potentiometer 322, causing a small negative voltage to be applied to control circuit 310. Amplifier 312 amplifies the potentiometer voltage applied to its positive input. A typical gain for amplifier 312 is 2. The output of amplifier 312 is applied to damper circuit 313 and follower 320, thus providing an output voltage of −5 volts at the output of amplifier 320 (−2.5 volts from the potentiometer 322, times the gain 2 of amplifier 312). There will also be a voltage drop of approximately 0.6 volts across diode 324, so the voltage at node 314 will be approximately −5.6 volts. Because the voltage at the anode of diode 324 (i.e., the output voltage of control circuit 310) is less negative than that at the cathode of diode 324 (i.e., the output voltage of control circuit 126'), diode 324 is forward-biased and the less negative output voltage of manual control circuit 310 is applied through node 314 to delay generator 122, overriding the output of control circuit 126'.

Thus, once the manual control is activated the voltage signal applied to delay generator 122 will be a constant voltage and accordingly a constant power will be delivered to the load, eliminating any oscillations in the melt.

The present invention may be embodied in other specific forms without departing from the spirit or essential attributes thereof and, accordingly, reference should be made to the appended claims, rather than to the foregoing specification, as indicating the scope of the invention.

I claim:

1. A control system for power delivered to an inductive load, comprising:

means for monitoring the power delivered to the load over time;

means for varying the power delivered to the load by controlling the phase difference between voltage and current delivered to the load;

phase-difference generating means for automatically generating a desired phase difference between voltage and current delivered to the load in response to the difference between the measured power delivered to the load and a desired power level; and means for introducing an external signal into the phase-difference generating means for superseding the automatic generation of the phase difference between voltage and current delivered to the load.

2. A control system as in claim 1, wherein the phase-difference generating means includes means for producing a voltage signal representative of the power delivered to the load at a given time, the means for varying the power delivered to the load further includes means responsive to the voltage signal, and the means for introducing an external signal into the phase-difference generating means further includes means for producing a non-time-varying voltage signal consistent with a non-time-varying power delivered to the load.

3. In an automatic control system for controlling power delivered to an inductive load, including feedback means for automatically controlling the phase difference between voltage and current delivered to the load in response to the measured power delivered to the load, a system for controlling power to the load comprising means for introducing an external signal into the feedback means for superseding the automatic control of the phase difference between voltage and current delivered to the load.

4. A system as in claim 3, wherein the feedback means further includes means for producing a voltage signal related to the measured power at a given time, and wherein the means for introducing an external signal into the feedback means includes means for producing a non-time-varying voltage signal consistent with non-time-varying power delivered to the load.

5. A control system for power delivered to an inductive load, comprising:

means for monitoring the power delivered to the load over time;

means for producing a voltage signal representative of the power delivered to the load at a given time;

phase-difference generating means for automatically generating a desired phase difference between voltage and current delivered to the load, including means responsive to the voltage signal representative of actual power delivered to the load at a given time;

means for generating a current signal representative of the difference between actual power delivered to the load and a desired power level;

means for varying the power delivered to the load by controlling the phase difference between voltage and current delivered to the load, said means including at least one charging capacitor adapted to be charged to a preselected voltage level by said current signal representative of the difference between actual power delivered to the load and a desired power, the preselected voltage level on the charging capacitor being related to the phase difference between voltage and current delivered to the load; and means for introducing an external voltage signal through the phase-difference generating means into the means for varying the power delivered to the load, said means for introducing including means for superseding the current signal by an external signal consistent with a non-time-varying current delivered to the at least one charging capacitor.

6. A control system as in claim 5, further including a diode operatively connected by its anode to the means for introducing an external voltage signal, and by its cathode to the means for producing a voltage signal representative of power delivered to the load and the means for varying the power delivered to the load, whereby the diode is forward-biased when the external voltage signal is less negative than the voltage signal representative of power delivered to the load.

* * * * *

UNITED STATES PATENT AND TRADEMARK OFFICE

CERTIFICATE OF CORRECTION

PATENT NO. : 5,165,049

DATED : November 17, 1992

INVENTOR(S) : Simeon Z. Rotman, et al

It is certified that error appears in the above-indentified patent and that said Letters Patent is hereby corrected as shown below:

On the title page,
item 75, after the Inventor designation of Simeon Z. Rotman, Brooklyn, N.Y. add --

Oleg S. Fishman, Maple Glen, PA--.

Signed and Sealed this

Twelfth Day of November, 1996

*Attest:*

Bruce Lehman

BRUCE LEHMAN

*Attesting Officer*

*Commissioner of Patents and Trademarks*